US011089878B2

(12) United States Patent
Moon et al.

(10) Patent No.: US 11,089,878 B2
(45) Date of Patent: Aug. 17, 2021

(54) ADJUSTABLE BED FOUNDATIONS AND RELATED METHODS

(71) Applicant: Purple Innovation, LLC, Alpine, UT (US)

(72) Inventors: Shawn David Moon, Cedar Hills, UT (US); Tony M. Pearce, Alpine, UT (US)

(73) Assignee: Purple Innovation, LLC, Lehi, UT (US)

( * ) Notice: Subject to any disclaimer, the term of this patent is extended or adjusted under 35 U.S.C. 154(b) by 416 days.

(21) Appl. No.: 15/835,052

(22) Filed: Dec. 7, 2017

(65) Prior Publication Data

US 2018/0168359 A1 Jun. 21, 2018

Related U.S. Application Data

(60) Provisional application No. 62/435,343, filed on Dec. 16, 2016.

(51) Int. Cl.
*A47C 21/00* (2006.01)
*A61H 1/00* (2006.01)
(Continued)

(52) U.S. Cl.
CPC ..... *A47C 21/006* (2013.01); *A47C 20/041* (2013.01); *A47C 20/08* (2013.01);
(Continued)

(58) Field of Classification Search
CPC ..... A47C 20/08; A47C 20/10; A47C 20/12; A47C 20/041; A47C 21/006;
(Continued)

(56) References Cited

U.S. PATENT DOCUMENTS 5,537,701 A * 7/1996 Elliott ..... A47C 19/005 5/616
6,106,576 A 8/2000 Fromson
(Continued)

FOREIGN PATENT DOCUMENTS

WO 2004028306 A1 4/2004

OTHER PUBLICATIONS

Taiwan Intellectual Property Office, "First Office Action," Taiwan Patent Application No. 106144221, dated Oct. 2, 2018.
(Continued)

*Primary Examiner* — David R Hare
(74) *Attorney, Agent, or Firm* — Dentons Durham Jones Pinegar

(57) ABSTRACT

An adjustable bed foundation includes an adjustable frame and at least one height adjuster configured to raise and lower a portion of the adjustable frame. The adjustable frame defines a support surface, a bottom surface opposite the support surface, and a plurality of lateral side surfaces intersecting each of the support surface and the bottom surface. A fabric at least partially covers the plurality of lateral side surfaces and is secured to a material covering the support surface. A massage device is disposed within the adjustable frame and configured to impart vibration to a mattress disposed on the adjustable frame. The massage device is secured to the adjustable frame by a flexible fastener, and a gap between the flexible fastener and the support surface is between about 2 mm and about 10 mm. Related methods are also disclosed.

22 Claims, 6 Drawing Sheets

(51) Int. Cl.

| | |
|---|---|
| ***A61H 23/02*** | (2006.01) |
| ***A47C 20/04*** | (2006.01) |
| ***A47C 20/08*** | (2006.01) |
| ***A47C 31/00*** | (2006.01) |
| ***A47C 27/08*** | (2006.01) |
| ***A61H 9/00*** | (2006.01) |

(52) U.S. Cl.
CPC ..... *A47C 31/008* (2013.01); *A61H 1/005* (2013.01); *A61H 9/00* (2013.01); *A61H 23/0263* (2013.01); *A47C 27/082* (2013.01); *A61H 2201/0107* (2013.01); *A61H 2201/0142* (2013.01); *A61H 2201/0146* (2013.01); *A61H 2201/0188* (2013.01); *A61H 2201/0192* (2013.01); *A61H 2201/02* (2013.01); *A61H 2201/0242* (2013.01); *A61H 2201/5023* (2013.01)

(58) Field of Classification Search
CPC ..... A47C 27/082; A47C 31/008; A61H 23/0263; A61H 1/005; A61H 9/00; A61H 2201/0192; A61H 2201/0188; A61H 2201/0146; A61H 2201/0107; A61H 2201/02; A61H 2201/5023; A61H 2201/0142; A61H 2201/0242
See application file for complete search history.

(56) References Cited

U.S. PATENT DOCUMENTS

| | | | | |
|---|---|---|---|---|
| 6,684,423 | B2 * | 2/2004 | Godette | A47C 21/006 5/600 |
| 7,039,970 | B1 * | 5/2006 | Long | A47C 21/006 5/600 |
| 7,146,662 | B1 * | 12/2006 | Pollard | A47B 91/16 5/617 |
| 7,322,058 | B2 * | 1/2008 | Long | A47C 21/006 5/600 |
| 8,932,692 | B2 | 1/2015 | Pearce | |
| 2005/0000020 | A1 | 1/2005 | Schermel | |
| 2005/0039265 | A1 * | 2/2005 | Gladney | A47C 21/026 5/722 |
| 2005/0210587 | A1 * | 9/2005 | Piana | A47C 21/026 5/618 |
| 2008/0262657 | A1 * | 10/2008 | Howell | A47C 20/041 700/275 |
| 2009/0177327 | A1 * | 7/2009 | Turner | A47C 21/003 700/275 |
| 2011/0010860 | A1 * | 1/2011 | Grimes | A61H 1/005 5/616 |
| 2013/0043628 | A1 | 2/2013 | Pearce et al. | |
| 2013/0167302 | A1 | 7/2013 | Pearce | |
| 2015/0182418 | A1 | 7/2015 | Zaiss | |
| 2015/0313369 | A1 * | 11/2015 | Tarplee | A61H 23/0254 601/57 |
| 2016/0242558 | A1 * | 8/2016 | Rawls-Meehan | A47C 19/045 |

OTHER PUBLICATIONS

Taiwan Intellectual Property Office, "Decision of Rejection," Taiwan Patent Application 106144221, dated Dec. 25, 2018.
International Search Report for PCT Application No. PCT/US2017/065144 dated Mar. 28, 2018, 3 pages.
Written Opinion of the International Searching Authority for PCT Application No. PCT/US2017/065144 dated Mar. 28, 2018, 12 pages.
Taiwan Intellectual Property Office, "Notice of Third Office Action," Taiwan patent application No. 106144221, dated Nov. 15, 2019.
European Patent Office, "European Search Report," for European Application No. 17881826.6, dated May 19, 2020.
Korean Intellectual Property Office, "Notice of Preliminary Rejection," Korean Application No. 10-2019-7020571, dated Jun. 24, 2020.
Canadian Intellectual Property Office, "Examiner's Report," Canadian Application No. 3049205, dated Sep. 10, 2020.
Taiwan Intellectual Property Office, "Office Action," Taiwan Patent Application No. 106144221, dated Mar. 3, 2020.
Korean Intellectual Property Office, "Notice of Final Rejection," Korean Application No. 10-2019-7020571, dated Jan. 29, 2021.
Chinese National Intellectual Property Administration, "First Office Action," Chinese Application No. 201780084472.1, dated Mar. 1, 2021.

* cited by examiner

ADJUSTABLE BED FOUNDATIONS AND RELATED METHODS

CROSS-REFERENCE TO RELATED APPLICATION

This application claims the benefit under 35 U.S.C. § 119(e) of U.S. Provisional Patent Application Ser. No. 62/435,343, filed Dec. 16, 2016, the disclosure of which is hereby incorporated herein in its entirety by this reference.

FIELD

Embodiments of the present disclosure relate generally to mattress foundations and methods of forming and using mattress foundations.

BACKGROUND

Adjustable beds are beds having a mattress over an adjustable foundation or base. The adjustable foundation may be used instead of a box spring traditionally used for non-adjustable beds. Portions of the adjustable foundation can be raised or lowered by a user to raise or lower portions of a person resting on the mattress. For example, the foundation may be adjusted to raise a person's upper body for comfortable reading or watching television, or may be adjusted to raise a person's legs. Adjustable beds are commonly found in hospitals, but are becoming increasingly popular for home use.

Adjustable beds may include various features that make them desirable and valuable for consumers. For example, adjustable beds may include wireless remote controls, vibrating massage devices, under-bed lighting, or other features.

BRIEF SUMMARY

In some embodiments, an adjustable bed foundation includes an adjustable frame and at least one height adjuster configured to raise and lower a portion of the adjustable frame. The adjustable frame defines a support surface, a bottom surface opposite the support surface, and a plurality of lateral side surfaces intersecting each of the support surface and the bottom surface. A fabric at least partially covers the plurality of lateral side surfaces and is secured to a material covering the support surface. A massage device is disposed within the adjustable frame and configured to impart vibration to a mattress disposed on the adjustable frame. The massage device is secured to the adjustable frame by a flexible fastener, and a gap between the flexible fastener and the support surface is between about 2 mm and about 10 mm. By securing the massage device in this manner, the massage device can perform its function of providing vibration without interfering with the enjoyment of the bed when the massage device is not in use. In particular, the motor may not cause a lump in a mattress resting on the foundation.

A method of forming an adjustable bed foundation includes providing an adjustable frame defining a support surface, a bottom surface opposite the support surface, and a plurality of lateral side surfaces intersecting each of the support surface and the bottom surface; connecting at least one height adjuster to the adjustable frame such that the at least one height adjuster is configured to raise and lower a portion of the adjustable frame; securing a massage device within the adjustable frame with a flexible fastener such that the massage device is configured to impart vibration to a mattress disposed on the adjustable frame, and securing a fabric to a material covering the support surface. The fabric at least partially covers the plurality of lateral side surfaces. A gap between the flexible fastener and the support surface is between about 2 mm and about 10 mm.

In some embodiments, an adjustable bed foundation includes an adjustable frame defining a support surface, a bottom surface opposite the support surface, and a plurality of lateral side surfaces intersecting each of the support surface and the bottom surface; at least one height adjuster configured to raise and lower a portion of the adjustable frame; a fabric at least partially covering the plurality of lateral side surfaces and secured to a material covering the support surface; a massage device disposed within the adjustable frame and configured to impart vibration to a mattress disposed on the adjustable frame; a light secured adjacent a centerline of the adjustable bed foundation under the bottom surface of the adjustable frame; and a control module configured to adjust a height of a portion of the adjustable frame based on a clock. The massage device is secured to the adjustable frame by a flexible fastener, and a gap between the flexible fastener and the support surface is between about 2 mm and about 10 mm.

DETAILED DESCRIPTION

Figure 1:
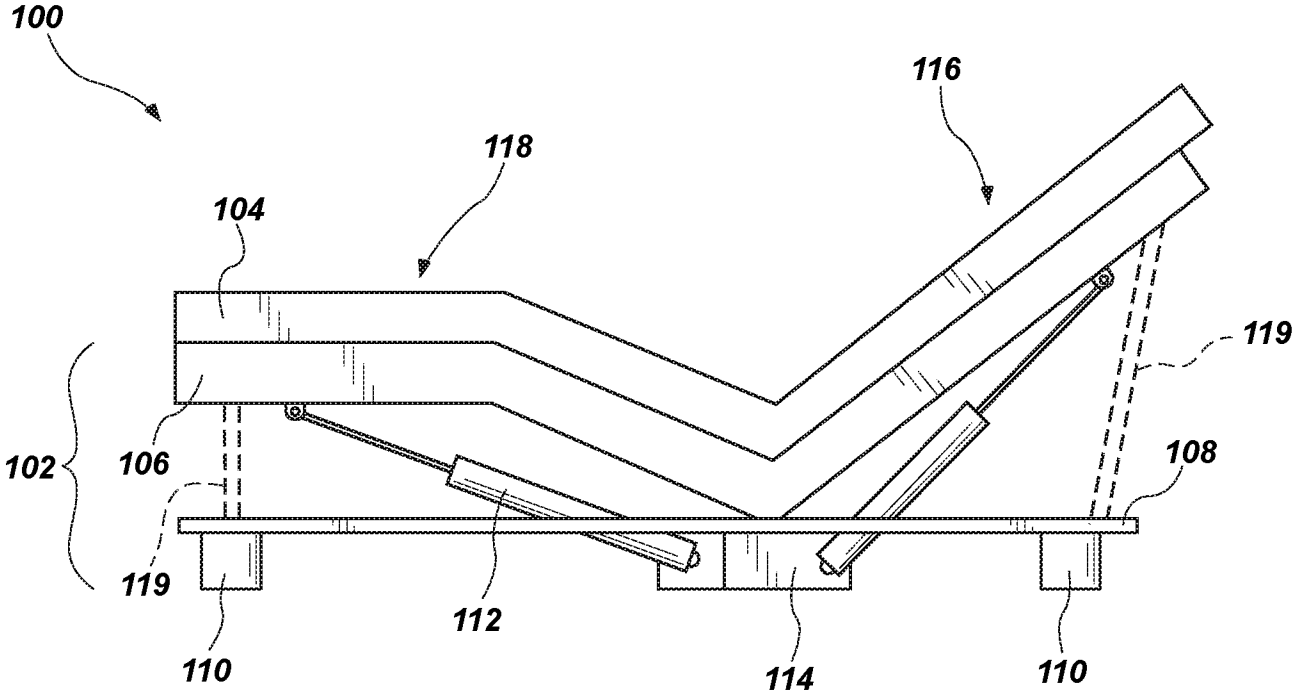
FIG. 1 is a simplified side view of an adjustable bed in a raised position, in accordance with an embodiment of the disclosure.

The illustrations presented herein are not actual views of any particular adjustable bed or foundation, but are merely idealized representations that are employed to describe example embodiments of the present disclosure. Additionally, elements common between figures may retain the same numerical designation.

The following description provides specific details, such as material types, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing a structure or assembly. Only those process acts and structures necessary to understand the embodiments of the disclosure are described in detail below. Additional acts to form the complete assembly from various structures may be performed by conventional fabrication techniques. Also note, any drawings accompanying the application are for illustrative purposes only, and are thus not drawn to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

FIG. 1 is a simplified side view of an adjustable bed 100. The adjustable bed 100 may include a foundation 102 and a mattress 104. The foundation 102 may include an adjustable frame 106, which may at least partially rest on a support structure 108. The support structure 108 may include or be supported by feet 110 resting on a floor. Portions of the adjustable frame 106 may be raised and lowered by one or more height adjusters 112 (e.g., pistons, levers, motors, etc.) associated with the support structure 108. The height adjusters 112 may be coupled to a controller 114 configured to cause the height adjusters 112 to move (e.g., by providing an electrical, pneumatic, or other signal to the height adjusters 112, such as via a microprocessor), which in turn moves the adjustable frame 106. In FIG. 1, the adjustable frame 106 is shown in a position in which a head portion 116 and a foot portion 118 of the adjustable frame 106 are raised.

Figure 2:
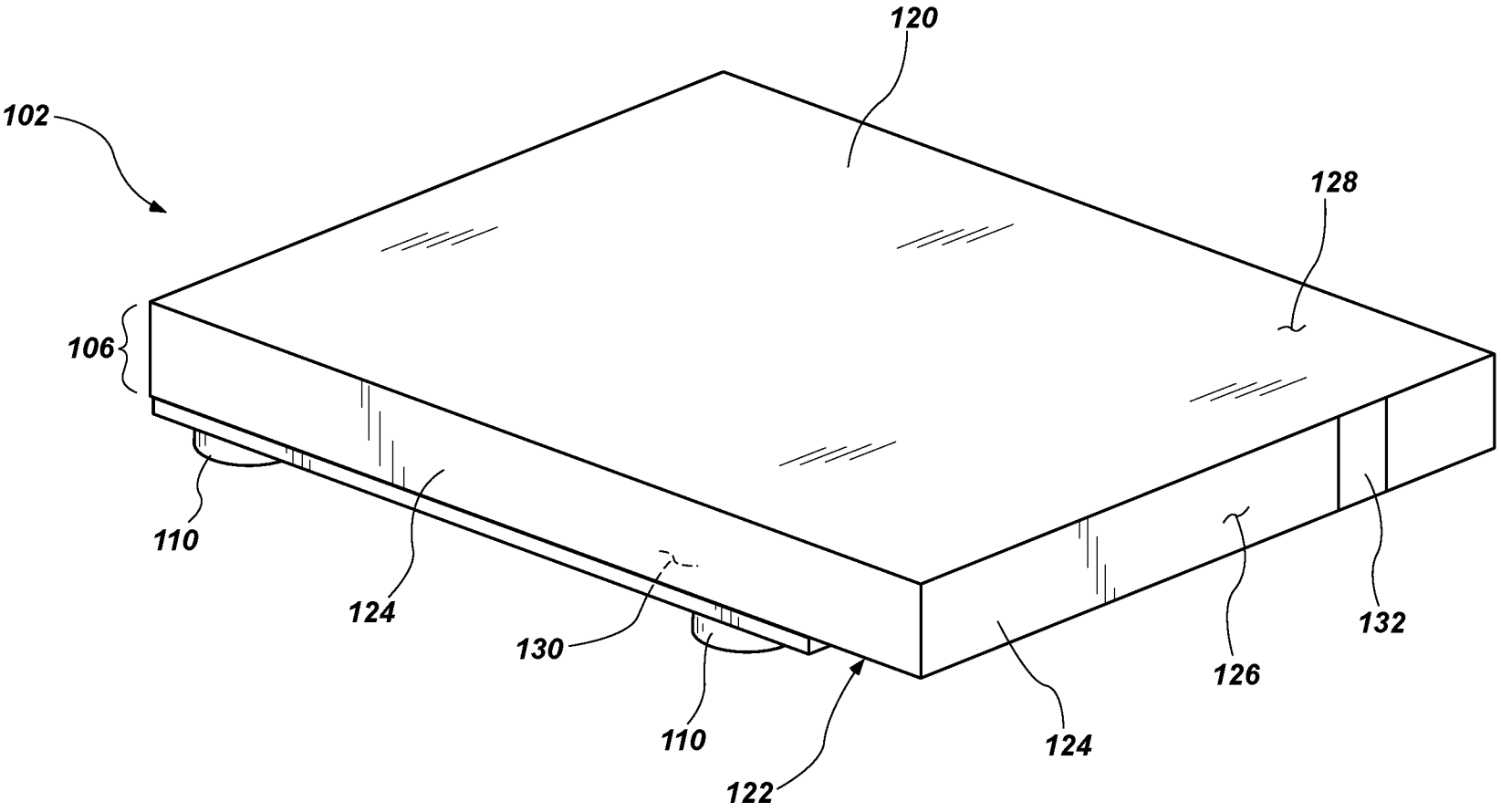
FIG. 2 is a simplified perspective view of the foundation of the adjustable bed shown in FIG. 1, in a flat position.

FIG. 2 shows the foundation 102 when the adjustable frame 106 is in a flat position. The adjustable frame 106 may define a support surface 120, a bottom surface 122 opposite the support surface 120, and a plurality of lateral side surfaces 124 intersecting each of the support surface 120 and the bottom surface 122. A fabric 126 (or "ticking") may at least partially cover the adjustable frame 106. For example, the fabric 126 may cover or surround the lateral side surfaces 124. In some embodiments, the fabric 126 may be stitched or otherwise secured along an intersection between the support surface 120 and the lateral side surfaces 124 to a material 128 covering the support surface 120. Another material 130 may cover the bottom surface 122 of the adjustable frame 106 (i.e., between the bottom surface 122 and the support structure 108 (FIG. 1)), to which the fabric 126 may also be secured. The materials 128, 130 may be the same composition as the fabric 126, or may be different compositions. For example, the fabric 126 and the materials 128, 130 may be a stretchable fabric, such as cotton tricot. In some embodiments, the fabric 126 may be a stretchable fabric, and the materials 128, 130 may be a non-stretchable material. In other embodiments, the fabric 126 and the material 130 may be a stretchable fabric, and the material 128 may be a non-stretchable material.

Figure 3:
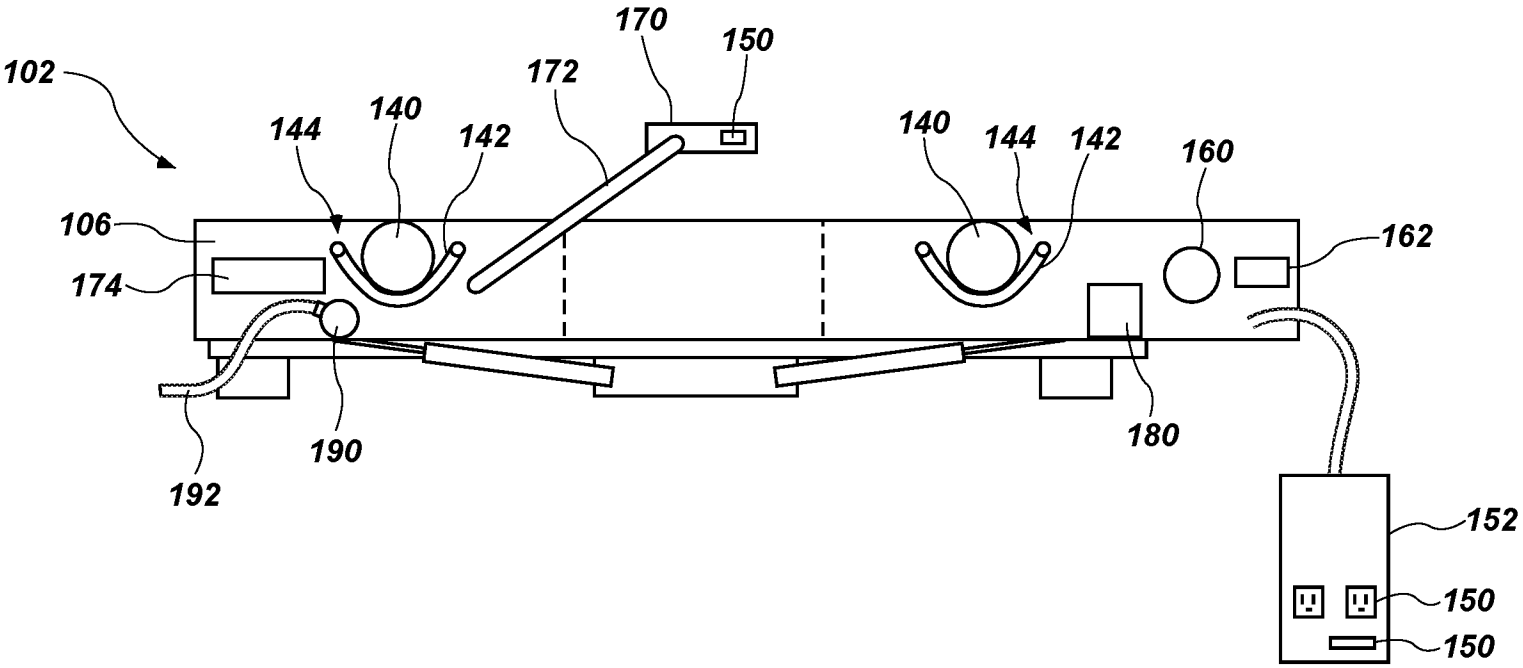
FIG. 3 is a simplified cross-sectional view of the foundation shown in FIG. 2.

FIG. 3 is a simplified cross-sectional side view of the foundation 102 shown in FIG. 2. In some embodiments, the foundation 102 may include one or more massage devices 140 disposed within the adjustable frame 106 and configured to impart vibration to a mattress 104 (see FIG. 1) disposed on the adjustable frame 106. The massage devices 140 may be independent units or modules, and may each include a motor that drives rotation of an eccentric mass (i.e., a mass that is asymmetrical with respect to at least one plane extending through the rotational axis of a drive shaft of the motor). In some embodiments, the massage devices 140 may be connected to the controller 114, and may be configured to receive control signals from the controller 114. The massage devices 140 may be disposed within and secured to the adjustable frame 106 by one or more flexible fasteners 142. The flexible fasteners 142 may be, for example, flexible cords, webbing material, etc. The flexible fasteners 142 may be configured such that a gap 144 between the flexible fasteners 142 and the support surface 120 (FIG. 2) is between about 1 mm and about 20 mm, such as between about 2 mm and about 10 mm, or between about 3 mm and about 5 mm. The massage devices 140 may be configured to impart vibration having a frequency between about 1 Hz and about 50 Hz to the mattress 104, such as a frequency between about 20 Hz and about 25 Hz. In some embodiments, the frequency, amplitude, or other properties of the massage devices 140 may be selected or optimized to distribute vibrations through a selected mattress material, such as buckling gel materials or other materials described in U.S. Patent Publication 2013/0167302, "Cushioning Elements Comprising Buckling Walls," published Jul. 4, 2013; U.S. Patent Publication 2013/0043628, "Cushioning Elements Comprising Buckling Walls and Methods of Forming Such Cushioning Elements," published Feb. 21, 2013; and U.S. Pat. No. 8,932,692, "Cushions Comprising Deformable Members and Related Methods," issued Jan. 13, 2015; the entire disclosure of each of which is hereby incorporated in its entirety by this reference.

The massage devices 140 may be used to provide a massaging function to a user of the adjustable bed 100. If the massage devices 140 are disposed such that a gap 144 is between the flexible fasteners 142 and the support surface 120, the user may not feel a lump or protrusion in the foundation 102 because the massage devices 140 may not be pushed as hard against the support surface 120. Thus, when the massage devices 140 are not in use, the user may not notice the presence of the massage devices 140. In contrast, massage devices supported by fasteners directly adjacent the support surface of an adjustable foundation, as in some conventional adjustable foundations, may cause the massage devices to form lumps or protrusions that makes some users uncomfortable (e.g., the users may feel the lumps or protrusions through a mattress), and that may be visible at the surface of the foundation (i.e., when the mattress is not on the foundation). The placement of the flexible fasteners 142 a distance below the support surface 120 may limit or avoid this protrusion, yet may still allow the massage devices 140 to contact the support surface 120 and to transmit vibrations to a mattress thereon.

In some embodiments, the foundation 102 may include or be connected to one or more electrical receptacles 150 configured to provide electrical power to an external device. For example, the electrical receptacles 150 may be within a stand 152, which may be connected to the foundation 102 by a wiring harness. The stand 152 may be configured to be placed on a bedside table for convenient access to the electrical receptacles 150 by a user of the adjustable bed 100 (FIG. 1). The foundation 102 may include multiple stands 152, such as one on each side of the foundation 102.

The electrical receptacles 150 may be configured to provide alternating current or direct current. In some embodiments, the electrical receptacles 150 may include standard two-prong or three-prong 110 V AC power, low voltage DC power via a USB connection, etc.

In some embodiments, the electrical receptacles 150 may include a connector for charging a remote control, a mobile phone or similar portable device. The electrical receptacles 150 may also include connections for transferring data to and from the portable device. The stand 152 may have a shape selected to cradle a remote control or mobile phone, such that the remote control or mobile phone connects to the electrical receptacles 150 for convenient charging and/or data transfer. The stand 152, if present, may simplify a user's access to electrical power, and may increase safety and convenience for the user (e.g., by limiting the need for extension cords, power adapters, etc., and by limiting the need for the user to move furniture to access electrical outlets).

The foundation 102 may optionally include one or more speakers 160 within the adjustable frame 106. The speakers 160 may be configured to receive an electrical signal from a signal generator 162. For example, the signal generator 162 may be an amplifier. The signal generator 162 may be configured to generate a signal corresponding to white noise, calming sounds, music, etc. The speakers 160 may then produce the white noise, calming sounds, music, etc. Such sounds may help some users fall asleep. The signal generator 162 may be configured to couple to a mobile phone or other external device, and to generate a signal corresponding to music or other sounds stored on the external device. For example, the signal generator 162 may be configured to receive signals via a wired or wireless connection (e.g., BLUETOOTH®). In some embodiments, the signal generator 162 may generate a signal without input from an external device, such as based on information stored in a memory connected to the signal generator 162.

In some embodiments, the foundation 102 may include a lap desk 170 coupled to the adjustable frame 106. The lap desk 170 may, for example, be removably attached to the adjustable frame 106, such that a user may detach the lap desk 170 for use while sitting on the adjustable bed 100 (FIG. 1). The lap desk 170 may be returned to a stowed position at a later time, such as when the user desires to sleep. The lap desk 170 may be adjustable to provide an ergonomic position for the user, and may include storage locations for books, electronic devices, remote controls, pens, beverages, or other items that the user may desire to keep available near the adjustable bed 100. The lap desk 170 may include built-in wrist rests, electrical receptacles 150 (e.g., as described above) lights, cup holders, etc. The lap desk 170 may be shaped such that a book or electronic device may be placed on the lap desk 170 for reading by a user without the user's holding the book or device. The lap desk 170 may include magnetic or other retention mechanisms to retain items to the lap desk 170. The lap desk 170 may be built into or attached to the foundation 102, such as by an adjustable arm 172, which may be moved to reposition the lap desk 170. In some embodiments, the lap desk 170 may be stored within an opening 174 in the foundation 102 when not in use.

In some embodiments, the adjustable frame 106 may define a storage compartment 180 therein. The storage compartment 180 may be sized and configured to receive any selected object or device. For example, some people sleep with a CPAP (continuous positive airway pressure) machine, and may desire to have a convenient location to stow the CPAP machine when not in use. The storage compartment 180 may be sized and configured to contain the CPAP machine, and may include a separate compartment for a mask and tubing associated with the machine. In some embodiments, the storage compartment 180 may be configured to retain the CPAP machine even when the CPAP machine is in use. For example, the storage compartment 180 may include ventilation holes and a power source for the CPAP machine, as well as a way to keep tubing attached to the CPAP machine when stowing the mask and tubing.

In some embodiments, the foundation 102 may include a built-in or attachable pump 190, which may be configured for pumping a fluid (water, air, another gas, or another fluid) for heating or cooling an article (e.g., a mattress, a mattress topper, a blanket, etc.) to improve comfort of a user. The pump 190 may be located within the adjustable frame 106, such that the pump 190 is not generally visible to occupants of the room in which the adjustable bed 100 is located. Furthermore, if the pump 190 is within the adjustable frame 106, the pump 190 may be hidden and may not take up space beneath the adjustable bed 100 or elsewhere within the room. The pump 190 may be connected to appropriate fluid flow lines 192 such that the pump 190 can circulate the fluid to the mattress 104, a mattress topper, a blanket, etc.

Figure 4:
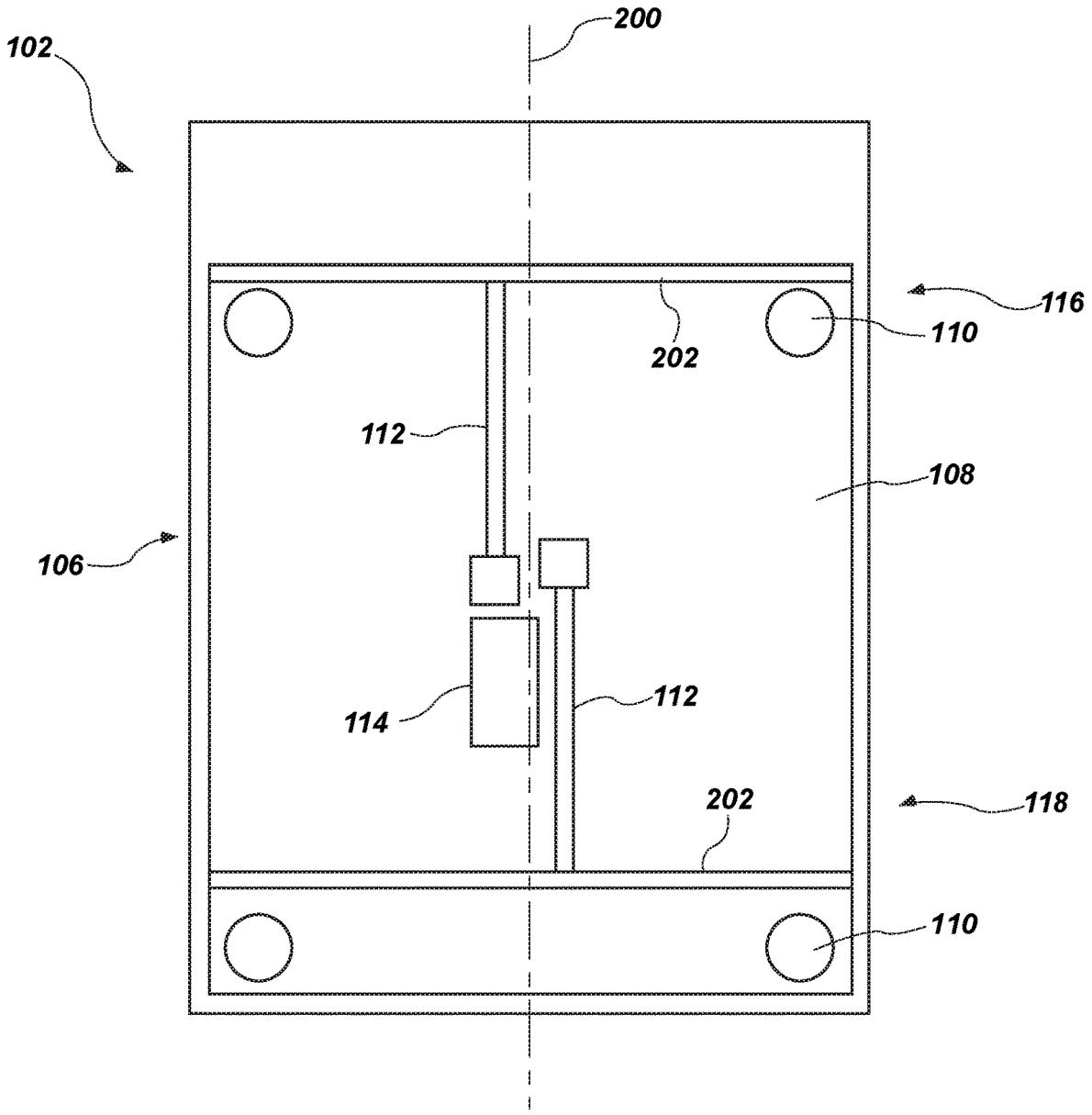
FIG. 4 is a simplified bottom view of the foundation shown in FIG. 2.

FIG. 4 shows a simplified bottom view of the foundation 102. The support structure 108 may include or be supported by the feet 110. The height adjusters 112 and the controller 114 may be located near a centerline 200 of the foundation 102, such that the height adjusters 112 can support the head portion 116 and the foot portion 118 of the adjustable frame 106. The height adjusters 112 may be connected to various structural supports 202 to enable the height adjusters 112 to lift the head portion 116 and the foot portion 118 of the adjustable frame 106. The controller 114 may be configured to move or change the size of the height adjusters 112 upon receipt of a signal from a user.

Figure 5:
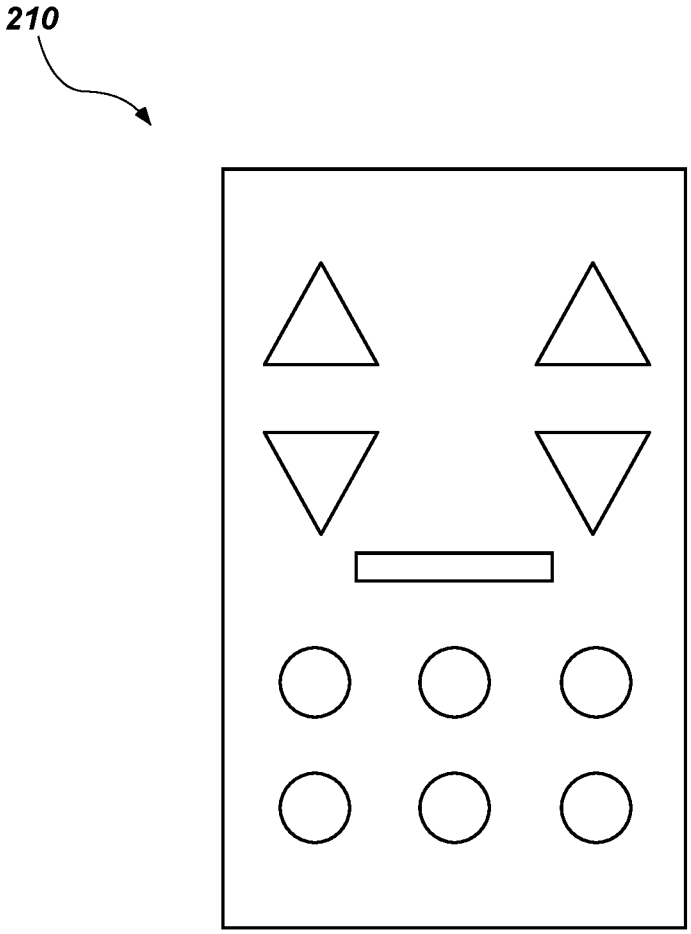
FIG. 5 is a simplified view of a remote control that may be used with the foundation of FIG. 2.

FIG. 5 shows a remote control 210 that may be configured to control various features of the foundation 102. For example, the remote control 210 may be a handheld device used to direct the controller 114 to raise or lower the head portion 116 or the foot portion 118, to adjust vibration of the massage devices 140, to adjust volume of sound generated by the speakers 160, to adjust a temperature of fluid flowing through the pump 190 to heat or cool the user, etc.

In some embodiments, the controller 114 may include a lighting module. For example, the lighting module may direct light to the ground adjacent the foundation 102, such that a user can see the ground at night when overhead or bedside lights are off. The light may be less disturbing to another (e.g., sleeping) user of the bed inasmuch as the light is directed at the ground, but may nonetheless be beneficial in guiding the user in an otherwise dark room. In some conventional adjustable foundations, a lighting module is located approximately midway between the centerline of the foundation and side, which results in different light intensities on opposite sides of the bed. If the controller 114 including a lighting module is located near the centerline 200 of the foundation 102, light emanating from each side of the foundation 102 may be of approximately the same intensity. Furthermore, any other feature associated with the controller 114 may be more readily accessible from both sides of the adjustable bed 100 if the controller 114 is located near the centerline 200 of the foundation 102. In some embodiments, a support beam or other obstruction may prevent the controller 114 from being exactly on the centerline 200.

The controller 114 may include a module configured to adjust a height of the head portion 116 and/or the foot portion 118 of the foundation 102 based on a clock or timer. For example, the module may accept an input from a user (e.g., via the remote control 210) to set a length of time after which the foundation 102 will move to another position or a set time of day when the foundation 102 will move to a selected position. The clock or timer may also be used to set a length of time for massage vibration, heat, light, sound, or other features. The clock or timer may, for example, help a user to rest or fall asleep by automatically changing the foundation 102 to a resting or sleeping position, or by adjusting other features.

In some embodiments, one or more of the features described above may be added to the foundation 102 after initial manufacturing and delivery to a consumer. For example, the foundation 102 may be shipped with the controller 114, but may omit one or more of the height adjusters 112, the massage devices 140, the electrical receptacles 150, or the pump 190. The controller 114 may include appropriate connections to add the height adjusters 112, the massage devices 140, the electrical receptacles 150, or the pump 190 at a later time, as desired by the consumer. Thus, the foundation 102 may have modular components. In embodiments in which one or more height adjusters 112 are omitted, the foundation 102 may include a manual lift and support mechanism, such as one or more metal support beams 119. Thus, the height of portions of the adjustable frame 106 may be changed by manually connecting the support beams 119. In the event the consumer decided to later add the height adjusters 112, the massage devices 140, the electrical receptacles 150, or the pump 190, these components could be installed into the foundation 102 by mechanically connecting them to the foundation 102 and electrically connecting them to the controller 114. The foundation 102 may include appropriate physical mounting points, and the controller 114 may include appropriate electrical connections, to add each component. Such a modular design may enable individual consumers to select which features are important to them at the time of purchase without paying for those features they do not expect to use, but still retain the option to add others later. The foundation 102 may be offered at a lower price when some components are omitted.

Figure 6:
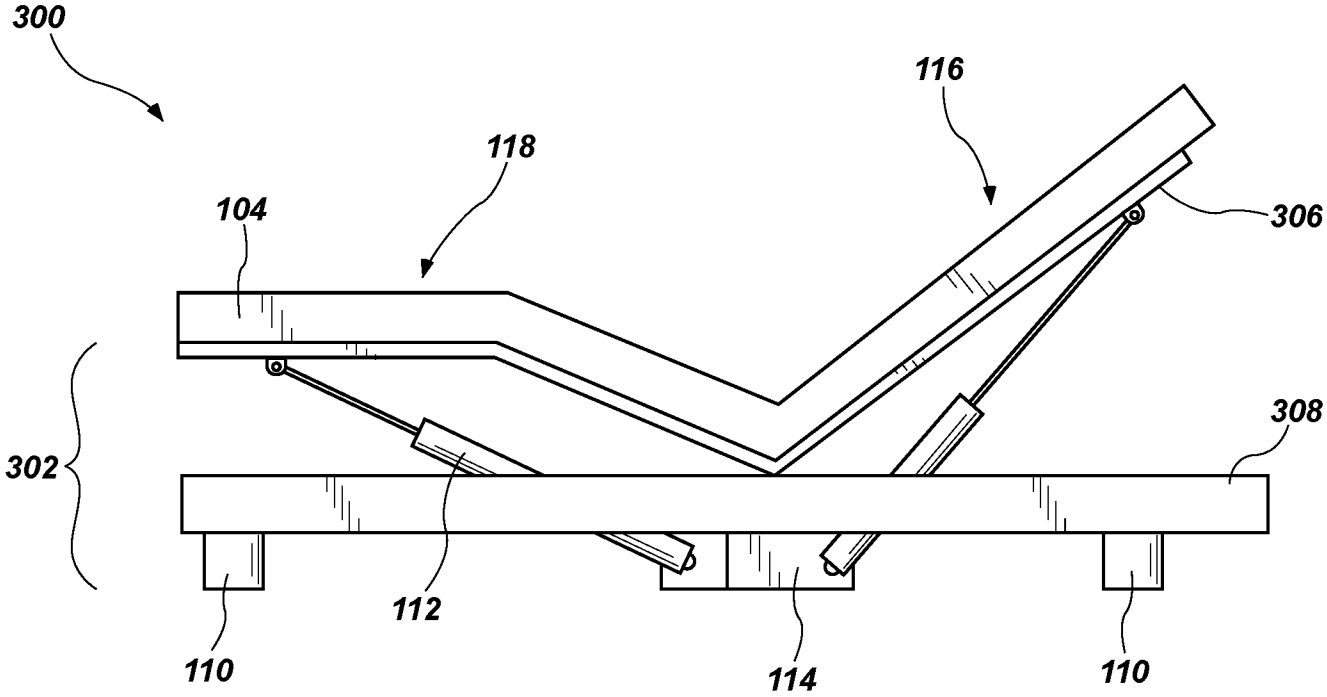
FIG. 6 is a simplified side view of another embodiment of an adjustable bed, in a raised position.

FIG. 6 is a simplified side view of an adjustable bed 300. Like the adjustable bed 100 shown in FIG. 1, the adjustable bed 300 may include a foundation 302 and a mattress 104. The foundation 302 may include an adjustable frame 306, which may at least partially rest on a base 308. The base 308 may have approximately the same lateral dimensions (e.g., length and width) as the mattress 104, such that when the adjustable frame 306 is in a lowered position, the mattress 104 and the base 308 have sides in common planes with one another. Such a base 308 may be referred to as "furniture style" because the base 308 is more visible and prominent as part of room décor than the support structure 108 shown in FIG. 1. However, in some embodiments and as shown in FIG. 1, the foundation 102 may be free of a base that extends to the edges of the mattress 104, which some consumers may prefer for aesthetic reasons.

The base 308 may include or be supported by feet 110 resting on a floor. Portions of the adjustable frame 306 (e.g., a head portion 116 and a foot portion 118) may be raised and lowered by one or more height adjusters 112 (e.g., pistons, levers, motors, etc.) associated with the base 308 and a controller 114, as discussed above with respect to FIG. 1.

Returning to FIG. 2, a sash 132 may be secured to the fabric 126, which may include branding, product safety information, or the like. The sash 132 may be secured at the head portion 116 of the adjustable frame 106. For example, the adjustable bed 100 (FIG. 1) may typically be placed such that the head portion 116 is against a wall or headboard when the adjustable bed 100 is in the flat position. If the sash 132 is along this side of the adjustable frame 106, the sash 132 may not be generally visible when the adjustable bed 100 is in the flat position. Thus, the sash 132 may include branding or other information without detracting from the décor of the room in which the adjustable bed 100 is placed. The sash 132 may nonetheless provide the branding or other information when the foundation 102 is installed or moved. The sash 132 may also be visible from above when the head portion 116 of the adjustable frame 106 is raised.

The sash 132 may be secured (e.g., sewn, adhered, fused, etc.) to the fabric 126 adjacent the intersection (e.g., a seam) between the support surface 120 and the lateral side surface 124, as well as adjacent the intersection between the bottom surface 122 and the lateral side surface 124. Furthermore, the sash 132 may be secured to the fabric 126 between the support surface 120 and the bottom surface 122. For example, the sash 132 may be secured to the fabric 126 along the lateral edges of the sash 132, or may be secured to the fabric 126 along a lateral centerline of the sash 132 (e.g., perpendicular to the intersection between the support surface 120 and the lateral side surface 124). The sash 132 may be secured along an entire length between the support surface 120 and the bottom surface 122, or may be secured at a selected location between the support surface 120 and the bottom surface 122.

Securing the sash 132 to the fabric 126 between the support surface 120 and the bottom surface 122 may keep the sash 132 from wrinkling under the weight of the mattress 104 (FIG. 1). For example, when the head portion 116 is raised, the mattress 104 may be partially folded, such that a portion of the mattress 104 may extend beyond the head portion 116 of the adjustable frame 106. The weight of the portion of the mattress 104 beyond the head portion 116 may bear on and compress the head portion 116 of the adjustable frame 106, which may tend to wrinkle the fabric 126 thereon. If the sash 132 were secured to the fabric 126 only at the top and bottom of the sash 132, compression of the adjustable frame 106 might cause separation of the middle of the sash 132 from the fabric 126, which may appear unfinished to a consumer. Thus, a foundation 102 in which the sash 132 is secured to the fabric 126 between the support surface 120 and the bottom surface 122 may be more commercially appealing, and may provide the perception of high quality. Furthermore, by securing the sash 132 in such a manner, the sash 132 may be more protected than a partially unsecured tag or label, and thus may be more durable.

Additional non-limiting example embodiments of the disclosure are described below.

Embodiment 1

An adjustable bed foundation comprising an adjustable frame and at least one height adjuster configured to raise and lower a portion of the adjustable frame. The adjustable frame defines a support surface, a bottom surface opposite the support surface, and a plurality of lateral side surfaces intersecting each of the support surface and the bottom surface. A fabric at least partially covers the plurality of lateral side surfaces and is secured to a material covering the support surface. A massage device is disposed within the adjustable frame and configured to impart vibration to a mattress disposed on the adjustable frame. The massage device is secured to the adjustable frame by a flexible fastener, and a gap between the flexible fastener and the support surface is between about 2 mm and about 10 mm.

Embodiment 2

The adjustable bed foundation of Embodiment 1, wherein the massage device is configured to impart vibration having a frequency between about 20 Hz and about 25 Hz to the mattress.

Embodiment 3

The adjustable bed foundation of Embodiment 1 or Embodiment 2, further comprising a sash secured to the fabric adjacent an intersection between the support surface and a lateral side surface of the plurality of lateral side surfaces, secured adjacent an intersection between the bottom surface and the lateral side surface, and secured to the fabric between the support surface and the bottom surface.

Embodiment 4

The adjustable bed foundation of Embodiment 3, wherein the sash has a height in a direction perpendicular to the support surface and a width in a direction parallel to the support surface, wherein the height is greater than the width.

Embodiment 5

The adjustable bed foundation of Embodiment 3 or Embodiment 4, wherein the sash is secured to the fabric along at least one edge of the sash.

Embodiment 6

The adjustable bed foundation of any of Embodiments 3 through 5, wherein the sash is secured to the fabric perpendicular to the intersection between the support surface and a lateral side surface.

Embodiment 7

The adjustable bed foundation of any of Embodiments 3 through 6, wherein the sash is secured to the fabric along an entire length between the support surface and the bottom surface.

Embodiment 8

The adjustable bed foundation of any of Embodiments 3 through 7, wherein the sash is secured at an edge of the sash to connect the sash to the material covering the support surface.

Embodiment 9

The adjustable bed foundation of any of Embodiments 1 through 8, further comprising at least one electrical receptacle configured to provide electrical power to an external device.

Embodiment 10

The adjustable bed foundation of Embodiment 9, wherein the at least one electrical receptacle is configured to provide at least one current selected from the group consisting of alternating current and direct current.

Embodiment 11

The adjustable bed foundation of any of Embodiments 1 through 10, further comprising at least one speaker within the adjustable frame.

Embodiment 12

The adjustable bed foundation of Embodiment 11, further comprising a signal generator configured to provide an electrical signal to the at least one speaker.

Embodiment 13

The adjustable bed foundation of Embodiment 12, wherein the signal generator is configured to communicate with a mobile electronic device.

Embodiment 14

The adjustable bed foundation of Embodiment 13, wherein the signal generator is configured to communicate wirelessly with the mobile electronic device.

Embodiment 15

The adjustable bed foundation of any of Embodiments 1 through 14, further comprising a lap desk coupled to the adjustable frame.

Embodiment 16

The adjustable bed foundation of Embodiment 15, wherein the lap desk is removably attached to the adjustable frame.

Embodiment 17

The adjustable bed foundation of any of Embodiments 1 through 16, wherein the adjustable frame defines a storage compartment therein.

Embodiment 18

The adjustable bed foundation of any of Embodiments 1 through 17, further comprising a pump within the adjustable frame.

Embodiment 19

The adjustable bed foundation of Embodiment 18, wherein the pump is configured to circulate a fluid in an article disposed over the adjustable frame.

Embodiment 20

The adjustable bed foundation of any of Embodiments 1 through 19, further comprising a light secured adjacent a centerline of the adjustable bed foundation under the bottom surface of the adjustable frame.

Embodiment 21

The adjustable bed foundation of any of Embodiments 1 through 20, further comprising a controller secured adjacent a centerline of the adjustable bed foundation under the bottom surface of the adjustable frame, the controller configured to cause the at least one height adjuster to move a portion of the adjustable frame.

Embodiment 22

The adjustable bed foundation of any of Embodiments 1 through 21, further comprising a remote control configured to enable a user to adjust at least one height adjuster.

Embodiment 23

The adjustable bed foundation of any of Embodiments 1 through 22, further comprising a control module configured to adjust a height of a portion of the adjustable frame based on a clock.

Embodiment 24

The adjustable bed foundation of any of Embodiments 1 through 23, further comprising a base under the adjustable frame, wherein the base comprises lateral side surfaces in common with the lateral side surfaces of the adjustable frame.

Embodiment 25

The adjustable bed foundation of any of Embodiments 1 through 23, further comprising a support structure under the adjustable frame, wherein a lateral extent of the support structure is less than a lateral extent of the adjustable frame when the adjustable frame is in a lowered position.

Embodiment 26

A method of forming an adjustable bed foundation, comprising providing an adjustable frame defining a support surface, a bottom surface opposite the support surface, and a plurality of lateral side surfaces intersecting each of the support surface and the bottom surface; connecting at least one height adjuster to the adjustable frame such that the at least one height adjuster is configured to raise and lower a portion of the adjustable frame; securing a massage device within the adjustable frame with a flexible fastener such that the massage device is configured to impart vibration to a mattress disposed on the adjustable frame, and securing a fabric to a material covering the support surface. The fabric at least partially covers the plurality of lateral side surfaces. A gap between the flexible fastener and the support surface is between about 2 mm and about 10 mm.

Embodiment 27

The method of Embodiment 26, further comprising securing a sash adjacent an intersection between the support surface and a lateral side surface of the plurality of lateral side surfaces; securing the sash adjacent an intersection between the bottom surface and the lateral side surface; and securing the sash to the fabric between the support surface and the bottom surface.

Embodiment 28

The method of Embodiment 27, wherein securing a sash adjacent an intersection between the support surface and a lateral side surface of the plurality of lateral side surfaces comprises stitching an edge of the sash to the material covering the adjustable frame and the fabric.

Embodiment 29

The method of Embodiment 27 or Embodiment 28, wherein securing a sash adjacent an intersection between the support surface and a lateral side surface of the plurality of lateral side surfaces comprises securing the sash over the fabric at a head of the adjustable bed foundation.

Embodiment 30

The method of any of Embodiments 27 through 29, wherein securing the sash to the fabric between the support surface and the bottom surface comprises securing the sash to the fabric along an entire length between the support surface and the bottom surface.

Embodiment 31

The method of any of Embodiments 27 through 30, wherein securing the sash to the fabric between the support surface and the bottom surface comprises securing the sash to the fabric perpendicular to the intersection between the support surface and a lateral side surface.

Embodiment 32

An adjustable bed foundation, comprising: an adjustable frame defining a support surface, a bottom surface opposite the support surface, and a plurality of lateral side surfaces intersecting each of the support surface and the bottom surface; a support structure supporting the adjustable frame and comprising at least one height adjuster configured to raise and lower a portion of the adjustable frame, a controller configured to adjust a height of a portion of the support structure; a remote control configured to send an electronic signal to the controller; and a stand coupled to support structure and comprising at least one electrical receptacle configured to provide alternating current to an external device and at least another electrical receptacle configured to provide direct current to another external device. The stand is structured and adapted to receive the remote control. A lateral extent of the support structure is less than a lateral extent of the adjustable frame when the adjustable frame is in a lowered position.

Embodiment 33

An adjustable bed foundation comprising an adjustable frame and at least one height adjuster configured to raise and lower a portion of the adjustable frame. A massage device is disposed within the adjustable frame and configured to impart vibration to a mattress disposed on the adjustable frame, wherein the massage device is disposed within the adjustable frame such that a gap between the massage device and the support surface is between about 2 mm and about 10 mm.

Embodiment 34

An adjustable bed foundation comprising an adjustable frame and at least one height adjuster configured to raise and lower a portion of the adjustable frame. The adjustable bed foundation is electrically connected to a stand comprising at least one electrical receptacle configured to provide electrical power to an external device.

Embodiment 35

An adjustable bed foundation comprising an adjustable frame, at least one height adjuster configured to raise and lower a portion of the adjustable frame, and at least one speaker disposed within the adjustable frame.

Embodiment 36

An adjustable bed foundation comprising an adjustable frame, at least one height adjuster configured to raise and lower a portion of the adjustable frame, and a lap desk coupled to the adjustable frame.

Embodiment 37

An adjustable bed foundation comprising an adjustable frame, at least one height adjuster configured to raise and lower a portion of the adjustable frame, and a pump within the adjustable frame.

Embodiment 38

An adjustable bed foundation comprising an adjustable frame and at least one height adjuster configured to raise and lower a portion of the adjustable frame. A light is secured adjacent a centerline of the adjustable bed foundation adjacent a bottom surface thereof.

Embodiment 39

An adjustable bed foundation comprising an adjustable frame, at least one height adjuster configured to raise and lower a portion of the adjustable frame, and a controller configured to adjust a height of a portion of the adjustable frame based on a clock.

Embodiment 40

An adjustable bed foundation, comprising: an adjustable frame defining a support surface, a bottom surface opposite the support surface, and a plurality of lateral side surfaces intersecting each of the support surface and the bottom surface; at least one height adjuster configured to raise and lower a portion of the adjustable frame; a fabric at least partially covering the plurality of lateral side surfaces and secured to a material covering the support surface; a massage device disposed within the adjustable frame and configured to impart vibration to a mattress disposed on the adjustable frame; a light secured adjacent a centerline of the adjustable bed foundation under the bottom surface of the adjustable frame; and a controller configured to adjust a height of a portion of the adjustable frame based on a clock. The massage device is secured to the adjustable frame by a flexible fastener, and a gap between the flexible fastener and the support surface is between about 2 mm and about 10 mm.

Embodiment 41

A method of forming an adjustable bed foundation, comprising providing a material covering an adjustable frame defining a support surface, a bottom surface opposite the support surface, and a plurality of lateral side surfaces intersecting each of the support surface and the bottom surface; securing a fabric to the material covering the support surface, the fabric at least partially covering the plurality of lateral side surfaces; securing a sash adjacent an intersection between the support surface and a lateral side surface of the plurality of lateral side surfaces; securing the sash adjacent an intersection between the bottom surface and the lateral side surface; and securing the sash to the fabric between the support surface and the bottom surface.

Embodiment 42

The method of Embodiment 41, wherein securing a sash adjacent an intersection between the support surface and a lateral side surface of the plurality of lateral side surfaces comprises stitching an edge of the sash to the material covering the adjustable frame and the fabric.

Embodiment 43

The method of Embodiment 41 or Embodiment 42, wherein securing a sash adjacent an intersection between the support surface and a lateral side surface of the plurality of lateral side surfaces comprises securing the sash over the fabric at a head of the adjustable bed foundation.

Embodiment 44

The method of any of Embodiments 41 through 43, wherein securing the sash to the fabric between the support surface and the bottom surface comprises securing the sash to the fabric along an entire length between the support surface and the bottom surface.

Embodiment 45

The method of any of Embodiments 41 through 44, wherein securing the sash to the fabric between the support surface and the bottom surface comprises securing the sash to the fabric perpendicular to the intersection between the support surface and a lateral side surface.

Embodiment 46

An adjustable bed foundation, comprising an adjustable frame, a support structure, and a controller. The adjustable frame defines a support surface, a bottom surface opposite the support surface, and a plurality of lateral side surfaces intersecting each of the support surface and the bottom surface. The support structure supports the adjustable frame and has physical mounting points configured to receive at least one modular height adjuster and at least one modular massage device. The controller has electrical connections configured to connect to the at least one modular height adjuster and the at least one modular massage device. The controller comprises a microprocessor programmed to send a signal to the at least one modular height adjuster to change a height of a portion of the adjustable frame. The microprocessor is also programmed to control operation of the modular massage device.

Embodiment 47

The adjustable bed foundation of Embodiment 46, further comprising at least one support beam configured to connect the adjustable frame to the support structure such that the support surface of the adjustable frame has at least one inclined portion.

Embodiment 48

The adjustable bed foundation of Embodiment 46 or Embodiment 47, wherein the support structure does not contain the at least one modular height adjuster or the at least one modular massage device.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various types and configurations of adjustable bed foundations.

What is claimed is:

1. An adjustable bed foundation, comprising:

an adjustable frame with a support surface, a bottom surface opposite from the support surface, and a plurality of lateral side surfaces adjoining the support surface and the bottom surface;

at least one height adjuster that selectively raises and lowers at least a portion of the adjustable frame;

a first fabric covering an upper extent of the support surface;

a second fabric at least partially covering the plurality of lateral side surfaces and secured to the first fabric covering the upper extent of the support surface; and an oscillator disposed within the adjustable frame; and a flexible fastener spaced about 2 mm to about 10 mm from the support surface securing the oscillator to the adjustable frame with an upper extent of the oscillator being substantially flush with the upper extent of the support surface and in a manner that enables vibration of a mattress resting on the support surface.

2. The adjustable bed foundation of claim 1, wherein the oscillator enables the vibration at a frequency of about 20 Hz to about 25 Hz.

3. The adjustable bed foundation of claim 1, further comprising:

a sash secured to:

the second fabric adjacent a corner between the upper extent of the support surface and a lateral side surface of the plurality of lateral side surfaces;

a corner between the bottom surface and the lateral side surface; and the second fabric over the lateral side surface, between the upper extent of the support surface and the bottom surface.

4. The adjustable bed foundation of claim 3, wherein the sash has a height in a direction perpendicular to the support surface and a width in a direction parallel to the support surface, the height being greater than the width.

5. The adjustable bed foundation of claim 3, wherein the sash is secured to the second fabric along at least one edge of the sash.

6. The adjustable bed foundation of claim 3, wherein the sash is secured to the second fabric perpendicular to the corner between the upper extent of the support surface and the lateral side surface.

7. The adjustable bed foundation of claim 3, wherein the sash is secured to the second fabric along an entire length of the corner between the upper extent of the support surface and the bottom surface.

8. The adjustable bed foundation of claim 3, wherein an edge of the sash is secured to a first fabric covering the upper extent of the support surface.

9. The adjustable bed foundation of claim 1, further comprising:

at least one speaker carried by the adjustable frame.

10. The adjustable bed foundation of claim 9, further comprising:

a signal generator that selectively communicates with an electronic device and provides an electrical signal to the at least one speaker.

11. The adjustable bed foundation of claim 1, further comprising:

a lap desk coupled to the adjustable frame.

12. The adjustable bed foundation of claim 1, wherein the adjustable frame defines a storage compartment.

13. The adjustable bed foundation of claim 1, further comprising:

a pump within the adjustable frame.

14. The adjustable bed foundation of claim 1, further comprising:

a light secured adjacent to a centerline of the adjustable bed foundation under the bottom surface of the adjustable frame.

15. The adjustable bed foundation of claim 1, further comprising:

a controller that selectively adjusts a height of at least a portion of the adjustable frame based on a clock.

16. The adjustable bed foundation of claim 1, further comprising:

a support structure under the adjustable frame and having a lateral extent that is less than a lateral extent of the adjustable frame when the adjustable frame is in a lowered position.

17. An adjustable bed, comprising:

a cushioning element comprising an elastomeric material;

an adjustable frame with a support surface on which the cushioning element rests, a bottom surface opposite from the support surface, and a plurality of lateral side surfaces that extend between an upper extent of the support surface and the bottom surface;

at least one height adjuster that selectively raises and lowers a portion of the adjustable frame;

a first fabric covering the upper extent of the support surface;

a second fabric at least partially covering the plurality of lateral side surfaces and secured to the first fabric covering the upper extent of the support surface;

an oscillator disposed within the adjustable frame; and a flexible fastener securing the oscillator to the adjustable frame in a manner that enables selective vibration of the cushioning element, the selective vibration being optimized for distribution throughout the elastomeric material of the cushioning element, the flexible fastener being spaced apart from the support surface to position an upper extent of the oscillator substantially flush with the upper extent of the support surface.

18. The adjustable bed foundation of claim 17, further comprising:

a sash secured to:

the second fabric adjacent to a corner between the upper extent of the support surface and a lateral side surface of the plurality of lateral side surfaces;

a corner between the bottom surface and the lateral side surface; and the second fabric over the lateral side surface, between the upper extent of the support surface and the bottom surface.

19. The adjustable bed of claim 17, further comprising:

at least one speaker carried by the adjustable frame.

20. The adjustable bed of claim 17, further comprising:

a lap desk coupled to the adjustable frame.

21. The adjustable bed of claim 17, further comprising:

a pump carried by the adjustable frame.

22. The adjustable bed of claim 17, further comprising:

a controller that selectively adjusts a height of at least a portion of the adjustable frame.

* * * * *